US007227468B1

(12) United States Patent
Florio

(10) Patent No.: US 7,227,468 B1
(45) Date of Patent: Jun. 5, 2007

(54) OBJECT INFORMATION RETRIEVAL SYSTEM

(76) Inventor: Erik David Florio, 444 Whispering Pines Dr., # 179, Scotts Valley, CA (US) 95066

( * ) Notice: Subject to any disclaimer, the term of this patent is extended or adjusted under 35 U.S.C. 154(b) by 221 days.

(21) Appl. No.: 10/956,821

(22) Filed: Sep. 30, 2004

(51) Int. Cl.
*G08B 13/14* (2006.01)

(52) U.S. Cl. ..... 340/572.1; 340/539.11; 235/375

(58) Field of Classification Search ..... 340/539.11
See application file for complete search history.

(56) References Cited

U.S. PATENT DOCUMENTS

| | | | | |
|---|---|---|---|---|
| 4,274,083 | A | 6/1981 | Tomoeda | |
| 4,654,658 | A | 3/1987 | Walton | |
| 6,259,367 | B1 * | 7/2001 | Klein | 340/572.1 |
| 6,294,999 | B1 | 9/2001 | Yarin et al. | |
| 6,380,858 | B1 | 4/2002 | Yarin et al. | |
| 6,412,086 | B1 | 6/2002 | Friedman et al. | |
| 6,563,417 | B1 | 5/2003 | Shaw | |
| 6,696,879 | B1 | 2/2004 | O'Toole et al. | |
| 6,970,088 | B2 * | 11/2005 | Kovach | 340/572.1 |
| 6,996,402 | B2 * | 2/2006 | Logan et al. | 455/456.1 |
| 2004/0087273 | A1 * | 5/2004 | Perttila et al. | 455/41.2 |
| 2005/0285746 | A1 * | 12/2005 | Sengupta et al. | 340/573.1 |
| 2006/0044146 | A1 * | 3/2006 | Ferguson et al. | 340/679 |

* cited by examiner

*Primary Examiner*—Daniel Wu
*Assistant Examiner*—George Bugg

(57) ABSTRACT

The invention is in the field of RFID tags and its use in activating a program related to an object. The invention uses the RFID tags and electronic readers to obtain the identification information about the object and use this information to trigger a program on a data processing device that is operatively connected to the electronic reader. The object is equipped with RFID tags that are encoded with the identification information of the object. The tags are read by an electronic reader, which in turn, decodes, verifies, validates and transmits decoded information about the object to the data processing device. The data processing device uses this information to search a database and activates the appropriate program about the object that includes audio and video portions.

17 Claims, 4 Drawing Sheets

OBJECT INFORMATION RETRIEVAL SYSTEM

FIELD OF THE INVENTION

The present invention generally relates to Radio Frequency communication (RFID) tags and, more particularly, is concerned with retrieving audio and video information on an object equipped with radio frequency communication tags, using an electronic reader.

BACKGROUND OF THE INVENTION

RFID systems are well known electronic devices and are mainly used in tracking objects and for providing security. RFID systems work by first recording identification of an object on the RFID tag. An electronic reader receives the identification information about the object from the RFID tag using radio frequency. Such systems include: a) relatively large packages containing battery powered transmission/receiving circuitry (active RFID tags with external power source), such as the identification system disclosed in U.S. Pat. No. 4,274,083, and b) passive systems in which the transponder (RFID tag) receives its power from the base station or interrogator (electronic reader), such as the identification system disclosed in U.S. Pat. No. 4,654,658.

A typical RFID system is made up of reusable RFID tags, an electronic reader with built-in antenna system that interrogates the RFID tags using a radio-frequency communication link and a host controller system. The host controller (or computer) system interfaces with the reader and directs the interrogation of the RFID tags. The RFID system thus provides effective means of identifying, monitoring, and controlling materials in a closed loop process. Typically, an RFID system is used in a manufacturing environment where the RFID tags are employed to track and monitor the objects, providing a record of where the objects are in the manufacturing process.

RFID tags are broadly classified into two categories—active and passive. A passive RFID tag uses the energy generated by the electronic reader to transmit and receive electronic signals. An active RFID tag uses a battery or an external power source to transmit and receive data. Generally, passive RFID tags have minimal maintenance and virtually unlimited life but have a small operating range. The life span of an active tag, on the other hand, is limited by the life of the battery (although some RFID tags have replaceable batteries) but have a large operating range. RFID tags have applicability based on the operating range.

Modern exercise equipments (exercise machines/objects) come with varied controls and exercise options. A typical user needs to be familiar with various controls and safety associated with the exercise equipments prior to beginning a workout on these equipments. In order to educate the typical user with the advantages and potentials of the exercise equipments and features associated with each equipment, a trainer knowledgeable about the exercise equipments has to be engaged. The trainer would, then, show the user the features and advantages of working out on each of the exercise equipments. Engaging a trainer needs lot of planning and is expensive. Users are inhibited by the additional costs associated in engaging a trainer.

Exercise equipments are used fairly regularly and need proper maintenance and repair depending on the frequency of use and wear. Newer equipments entering the market provide additional challenge for the users in the maintenance, usage and repair. Oftentimes, professional help is required for general maintenance and repairs. Scheduling the repair and maintenance requires a lot of planning, time, expense and the equipment to be out of use for set amount of time.

Thus, there is a need to utilize the available technology to provide an informative way of handling various exercise equipments so the users are made aware of the full potential of the exercise equipments and are encouraged to workout properly without any inhibitions.

There is also a need to minimize the cost associated with a routine workout and to encourage the users to use newer equipments.

There is also a need for providing a user with detailed information on how to operate each of the exercise equipments so that the user can operate them safely and efficiently.

There is also a need to eliminate or, at least, minimize the use of trainer so the user can work independently of the trainer.

There is also a need to use the available technology to provide detailed information about the exercise equipments and how to perform regular maintenance on these equipments.

There is also a need to use the available technology to provide detailed information about the exercise equipments, the problems that one can encounter in the exercise equipments and how to correct the common problems in these equipments.

There is also a need to minimize the inconvenience of engaging a professional for routine maintenance and general repair of the exercise equipments and to minimize the fee associated with the same.

SUMMARY OF THE INVENTION

It is, therefore, an object of the present invention to utilize an RFID tag assembly and system to provide an informative way of handling various exercise equipments so the users are encouraged to workout efficiently without any inhibitions.

It is another object of the invention to minimize the cost associated in familiarizing the user with safe handling of various exercise equipments by providing the users detailed information on how to operate various exercise equipments safely and efficiently.

It is another object of the invention to provide on-demand training for the user on how to operate the various exercise equipments effectively to achieve a desired result.

It is another object of the invention to provide on-demand detailed information about the exercise equipments, common problems encountered with these exercise equipments, detailed directions for fixing the problem, and for general maintenance of the exercise equipments thereby reducing the professional cost associated with the repair and routine maintenance of the exercise equipments.

The current invention, according to one embodiment, offers detailed information to a user of how to operate an exercise equipment by utilizing a RFID (Radio Frequency Identification Device) tag system. The RFID tag system also provides detailed information about the exercise equipment, detailed instructions on how to perform general maintenance on these equipments, problems encountered with the exercise equipment, and detailed information on how to fix the problems.

The RFID tag system includes a RFID tag 10 or a transponder, an electronic reader 30 or an interrogator and a host controller (a computer or a data processing device 50) connected to the electronic reader using communication links 40. The RFID tag 10 comprises an integrated circuit (IC) to regulate communication with the with the electronic reader 30, a memory bank to store the identification information of the exercise equipment and an antenna for transmitting and receiving signals. The RFID tag 10 is placed on an object 20 and is encoded with the identification information of the object 20. The electronic reader 30 comprises electronics to send and receive signals to and from the RFID tag 10, a microprocessor to check and decode inbound data from the RFID tag 10, a memory to store further transmission information and an antenna located remotely or proximate to the electronic reader 30 for sending and receiving electronic signals. The electronic reader is positioned within the operative distance of the RFID tag 10 to enable the electronic reader to communicate with the RFID tag 10. The electronic reader 30 is also connected to a data processing device 50 by a communication link 40. The RFID tag 10 could be a passive tag (using the energy from the reader to activate and transmit identification information) or an active tag (with external power source).

In one embodiment, the RFID tag 10 is placed proximate to the exercise equipment (object/exercise machine) 20 and provides identification information of the object 20. In this embodiment, the RFID tag 10 is a passive tag although an active tag could also be used. An electronic reader 30 entering the operating zone of the RFID tag 10, activates the RFID tag 10. The activated RFID tag 10 sends out the identification information of the object 20 as electronic signals to the electronic reader 30 at a pre-determined frequency. The electronic reader 30 tuned to the pre-determined frequency receives the signals, decodes, verifies and validates the information. The electronic reader 30 is operatively connected to a data processing device 50 using a communication link 40. The electronic reader 30, upon validation of the data received from the RFID tag 10, transmits the information to the data processing device 50 using the communication link 40. The data processing device 50, upon receipt of the information from the electronic reader 30, queries a database and triggers a program associated with the object 20 on to an output device connected to the data processing device 50. The program associated with the object 20 provides detailed audio and video information on the object 20.

In another embodiment, the RFID tag 10 is an active tag with its own power source. The RFID tag 10 is placed proximate to the exercise equipment (object/exercise machine) 20 and carries the identification information related to the object 20. The RFID tag 10, which is always active, transmits the identification information of the object 20 using a pre-determined frequency within the operating range of the RFID system. The electronic reader 30 tuned to the pre-determined frequency, when it enters the operating zone of the RFID tag 10, receives the electronic signal from the RFID tag 10, decodes and validates the information of the RFID tag 10. The electronic reader 30, upon decoding and validating the information from the RFID tag 10, transmits the information to a data processing device 50 operatively connected to the electronic reader 30 using a communication link 40. The data processing device 50, upon receiving the information from the electronic reader 30, queries a database and activates an appropriate program associated with the object 20, on to an output device connected to the data processing device 50. The program provides detailed audio and video information on the object 20.

In another embodiment, a plurality of exercise equipments (objects/exercise machines), for example, objects 20-1—through 20-4 are each provided with a RFID tag 1–4 respectively. The electronic reader 30 is capable of receiving the identification information on each of the plurality of objects 20-1 through 20-4. Each RFID tag 1–4 is placed proximate to the respective plurality of objects 20-1 through 20-4 and provides identification information of the respective object 20-1 through 20-4. The RFID tags 1–4, in this embodiment, are passive tags although active tags could be used. An electronic reader 30 enters the zone of a RFID tag 1 for, object 20-1, for example, and activates the object 20-1's RFID tag 1. The activated RFID tag 1 sends out identification information of object 20-1 to the electronic reader 30. The electronic reader 30, upon decoding and validation of the data received from the particular RFID tag 1, transmits the information to a data processing device 50 using a communication link 40. The data processing device 50 queries a database within the data processing device 50 and triggers a program associated with the object 20-1 onto an output device attached to the data processing device 50. When the electronic reader 30 enters the zone of object 2-0-2's RFID tag 2, the RFID tag 2 transmits the information about object 20-2 to the electronic reader 30, which decodes and validates the information and transmits the object 20-2's detailed information to the data processing device 50. The data processing device 50 then queries the database and triggers the program associated with object 20-2 onto the output device.

In another embodiment, the computing device houses both the electronic reader 30 and the data processing device 50. In this embodiment, the RFID tag 10 is a passive tag and is placed proximate to the exercise equipment (object/exercise machine) 20 and carries the identification information related to the object 20. The RFID tag 10 activated using an electronic reader 30, in turn, transmits the identification information of the object 20 using a pre-determined frequency within the operating range of the RFID system. The electronic reader 30 tuned to the pre-determined frequency, when in the operating zone of the RFID tag 10, receives the electronic signal from the RFID tag 10, decodes and validates the information of the RFID tag 10. The electronic reader 30, upon decoding and validating the information from the RFID tag 10, transmits the information to the data processing device 50 operatively located alongside the electronic reader 30 within the computing device. The data processing device 50, upon receiving the information from the electronic reader 30, queries a database within the data processing device 50, and activates an appropriate program associated with the object 20, on to an output device connected to the computing device. The program provides detailed audio and video information on the object 20.

In another embodiment, the RFID tag 10 is a passive tag and placed proximate to the exercise equipment (exercise machine/object) 20 and provides identification information of the object 20. An electronic reader 30 entering the operating zone of the RFID tag 10 activates the RFID tag 10. The activated RFID tag 10 sends out its identification information as electronic signals to the electronic reader 30 at a pre-determined frequency. The electronic reader 30 tuned to the pre-determined frequency receives the signals, decodes, verifies and validates the information. The electronic reader 30 is operatively connected to a data processing device 50 using a communication link 40. The electronic reader 30, upon validation of the data received from the RFID tag 10, transmits the information to the data processing device 50 using the communication link 40. The data processing device 50, upon receipt of the information from the electronic reader 30, queries the database and triggers a program associated with the object 20 on the data processing device 50. The program associated with the object 20 provides detailed audio and video information on the object 20, including how to do routine maintenance and general repair on the object 20. The detailed audio and video information is presented on an output device attached to the data processing device 50.

The foregoing brief description and the following detailed description along with detailed drawings are exemplary and are intended to explain the claimed invention.

DETAILED DESCRIPTION OF THE INVENTION

In accordance with a preferred embodiment of the invention, a system is provided to transmit information about an exercise equipment (object/exercise machine) 20 using communication links capable of communicating data about the object 20 to a data processing device 50. The data processing device 50, in turn, triggers a program on an output device attached to it, based on the information received about the object 20. More specifically, the system allows for using radio frequency communication tags and electronic readers to communicate information about the object 20 between the object's 20 RFID tag 10 and the data processing device 50.

Figure 1:
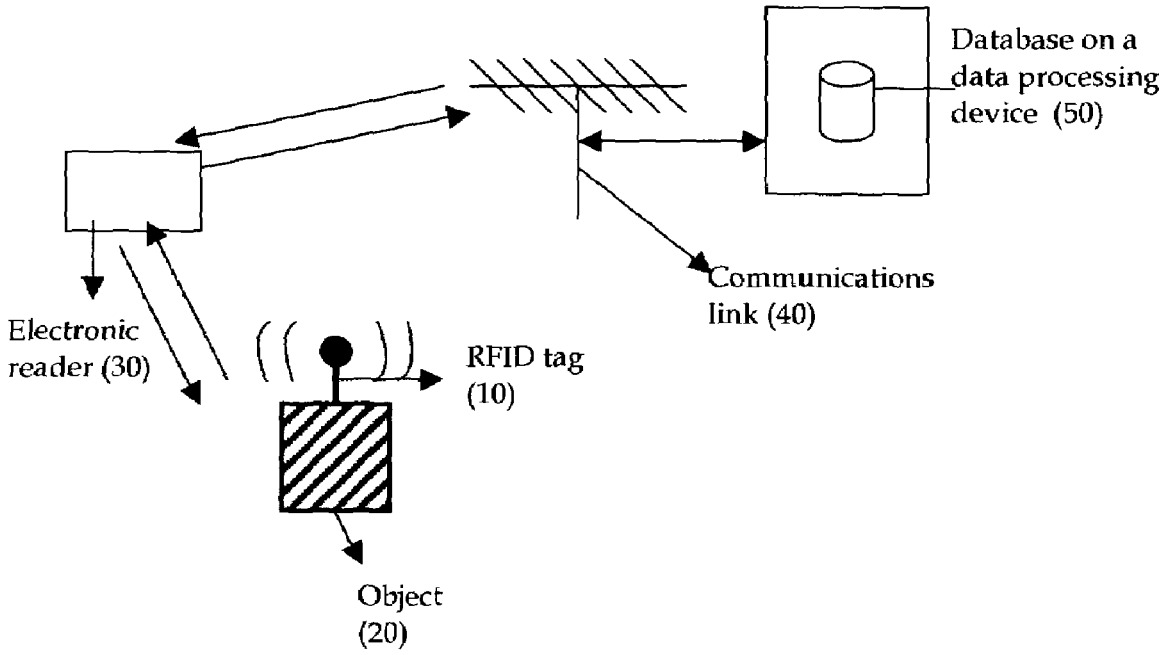
FIG. 1 is a schematic representation of an object information retrieval system using communication devices capable of transmitting and receiving electronic signals.

FIG. 1 is a schematic representation of a system that is used to communicate information about an exercise equipment 20 (object/exercise machine) between the RFID tag 10 and a data processing device 50 using radio frequency communications. A RFID system comprises a Radio Frequency Identification Device tag (RFID tag) 10, an electronic reader 30 and data processing device 50 operatively connected to the electronic reader 30.

The RFID tag (transponder) 10 comprises a customized integrated circuit or silicon chip, a memory bank, an antenna attached to the integrated circuit/silicon chip and a tuning capacitor. The integrated circuit/silicon chip regulates the communication between the RFID tag 10 and the electronic reader 30. The identification information related to the object 20 is stored in a memory bank of the RFID tag 10. The size of the antenna determines the operating distance of the RFID tag 10. The tuning capacitor allows for adjusting the tuning frequency of the RFID tag 10 for better communication with the electronic reader 30. The RFID tag 10 could be an active tag or a passive tag. An active tag has its own power source (an internal battery or an external power source) and uses this power source to get activated and to transmit electronic signals. The passive tag, on the other hand, receives power from an electronic reader 30 to get activated and to transmit electronic signals. The RFID tag 10 could be a read-only tag or a read-write tag. A read-only RFID tag 10 is where the identification information of an object is written onto the RFID tag once and is transmitted one or more times using electronic signals, for the reader to read the electronic signals so transmitted. A read-write RFID tag has the capability of writing the identification information of an object, transmitting the identification information and re-writing some or all of the information on the RFID tag. For this invention, a read-only tag is, employed. The RFID tag 10 can be placed on an object, within an object or proximate to an object whose identification it carries and transmits to the electronic reader 30. The placement of the RFID tag 10 with respect to an object is in such a way as to allow un-interrupted transmission of the identification information of the object 20.

The electronic reader 30 (interrogator) comprises electronics to receive and transmit radio frequency information from the RFID tag 10, a microprocessor to check, decode and validate the information received from the RFID tag 10, a memory to store data for further transmission and an antenna for receiving and transmitting electronic signals. The size of the antenna on the electronic reader 30, as in RFID tag 10, determines the operating range of the electronic reader 30. The electronic reader 30 could be placed within any device or on any device or surface, that is mobile or stationary, or it could be a stand-alone unit operatively connected to the data processing device 50, using communication links 40 and is capable of electronic communications with the RFID tag 10 and the data processing device 50.

A data processing device 50 (controller) is connected to the electronic reader 30 using communication link 40. Data processing device 50 are computing devices such as a personal computer, a desk-top computer, a computer workstation, or mobile devices such as a palm computing device, a PDA (Personal Digital Assistant), a smart-phone, a cell phone or any other computing device capable of housing a database. Typical communication links are hard-wired cable links or wireless technology communication links available commercially. Examples of wireless technology communication links may be the Blue tooth technology, 802.11 technology, 802.11a technology (for short operating range) or 802.11b technology (for longer operating range). The data processing device 50 houses a database comprising information on multiple objects 20. The information on the object 20 includes audio and/or video details. The database then triggers a program about object 20 in the form of audio and/or video clips that get transmitted to the output device for display on the output device. The output device could be an audio, a video or an audio and video device (not shown) and may be located proximate to the electronic reader 30, proximate to the object 20, or proximate to the data processing device 50. The communication between the computing device and the output device may be wired or wireless.

FIG. 1 represents the schematic representation of the system in one embodiment of the invention. In this embodiment an RFID tag 10 is encoded with identification information of an exercise machine (object/exercise machine) 20. The RFID tag 10 used in this embodiment is a read-only tag and the identification information is encoded once on the tag and is transmitted one or more times using electronic signals, for the reader to read the electronic signals so transmitted. The RFID tag 10, with the encoded identification information of the object 20, is placed proximate to the object 20 to allow transmission of information electronically without interruption. In this embodiment, it is placed on the object 20. It could be placed closer to the object 20 or within the object 20.—The RFID tag 10, in this embodiment, is a passive tag. The electronic reader 30 could be placed on or within any device (mobile or stationary) or surface capable of allowing electronic communications or it could be a stand-alone unit operatively connected to the data processing device 50 using communication links 40. The electronic reader 30, in this embodiment, is placed within a mobile computing device such that the electronic reader 30 can send and receive electronic signals. The mobile computing device could be a palm computing device, a PDA (Personal Digital Assistant), a smart-phone, a cell phone or any other hand-held device capable of being carried by a user. A data processing device 50 is operatively connected by communication link 40 to the electronic reader 30. The communication link 40 could be any one of wired (hard-wired network cable connections) or wireless communication links available commercially. The data processing device 50 houses a database comprising information on multiple objects 20. The information on the object 20 includes audio and/or video details. The electronic reader 30 receives the identification information about the object 20, decodes, validates the information and queries the database on the data processing device 50 for information relating to object 20. The database then triggers a program about object 20 in the form of audio and/or video clips that get transmitted to the output device for display on the output device. The output device could be an audio, a video or an audio and video device (not shown) and may be located proximate to the electronic reader 30, proximate to the object 20, or proximate to the data processing device 50. The communication between the computing device and the output device may be wired or wireless.

Figure 1A:
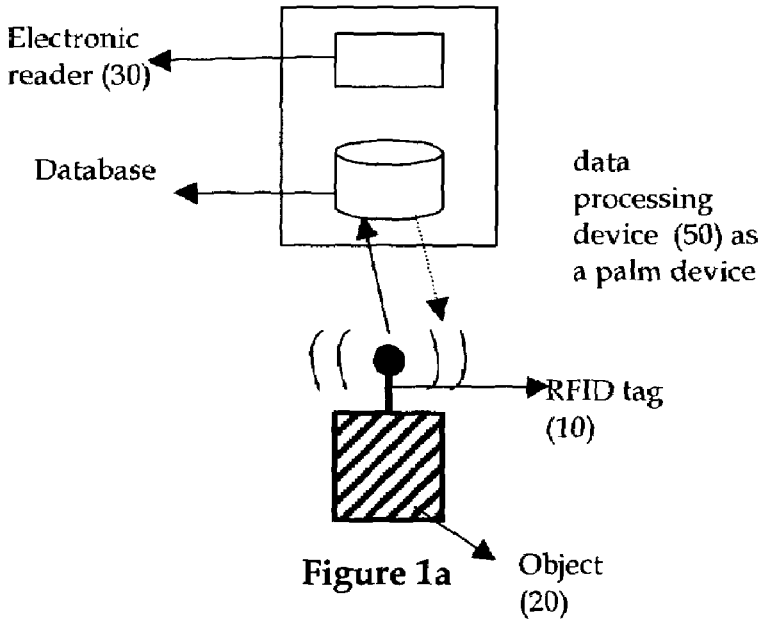
FIG. 1*a* is a schematic representation of an object information retrieval system wherein the electronic reader and the data processing device are embedded into a computing device. The computing device could be a palm device that a user can carry around.

In another embodiment of the invention, the data processing device 50 housing a database could be incorporated within a mobile computing device such as a palm device, and the electronic reader 30 can be operatively integrated with the data processing device 50 within the mobile computing device such that the electronic reader 30 can send and receive electronic signals, as illustrated in the schematic representation of the system in FIG. 1*a*. In this embodiment, the RFID tag 10 is a passive tag, located on an exercise equipment (object/exercise machine) 20, and receives electronic signals from the electronic reader 30 to get activated. When the palm device enters the operating zone of the RFID tag 10, the electronic signal from the electronic reader 30 (embedded in the palm device) activates the RFID tag 10. The activated RFID tag 10 starts transmitting identification information about the object 20. The electronic reader 30 receives the identification information about the object 20 from the RFID tag 10, decodes and validates the information and queries the database on the data processing device 50 for information relating to object 20. The database then triggers a program about object 20 in the form of audio and/or video clips that get transmitted to the output device for display on the output device. The output device could be an audio, a video or an audio and video device (not shown) and may be located proximate to the electronic reader 30, proximate to the object 20, or proximate to the data processing device 50. The communication between the computing device and the output device may be wired or wireless.

Figure 2:
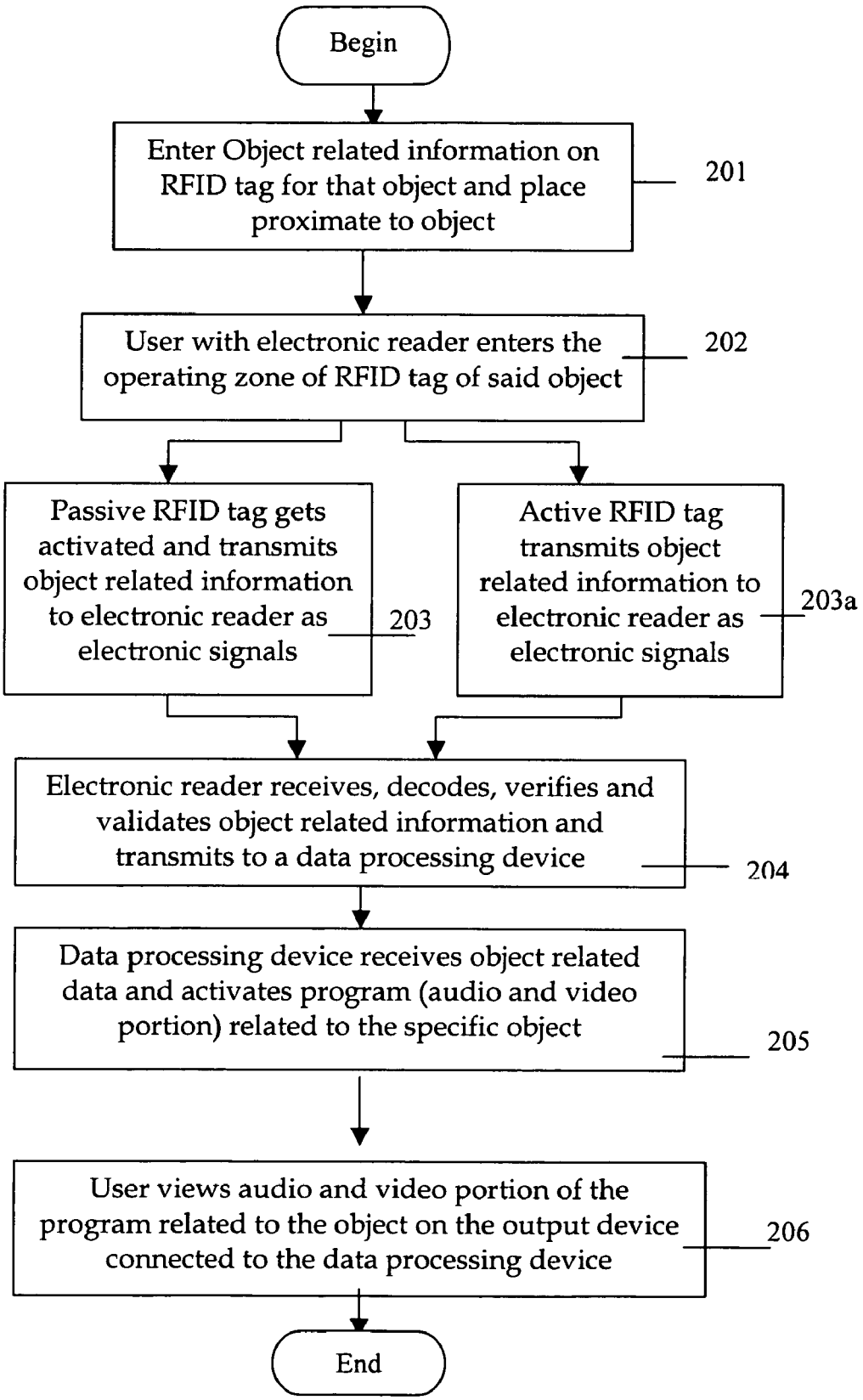
FIG. 2 is a flowchart of the process of reading the RFID tag associated with an exercise equipment and using it to trigger the appropriate program for the object on a data processing device, according to one embodiment of the invention.

FIG. 2 is a flowchart of the various steps involved in reading identification information of an exercise equipment (object/exercise machine) 20 using radio frequency communications and using the information to trigger a program in accordance with a preferred embodiment of the current invention. Referring to FIG. 2 step 201, a RFID tag 10 is encoded with information related to the object 20. A machine or part of a machine could be used in place of the exercise equipment 20. The RFID tag 10 used in this embodiment is a passive tag. The RFID tag 10 with the encoded information of the object 20 is placed proximate to the object 20. Proximate, as used in this application, means operatively close to, inside or on the subject. An electronic reader 30 could be placed proximate to a computing device or could be a stand-alone unit capable of communicating electronic signals with RFID tag 10 and data processing device 50. The electronic reader 30, in this embodiment is placed on a mobile computing device such as palm device carried by a user. The palm device may be a cell phone, a Personal Digital Assistant (PDA), a smart-phone or any other hand-held device that allows communication of electronic signals between the RFID tag 10 and the electronic reader 30. In the next step 202 of FIG. 2, the user, with a palm device equipped with electronic reader, enters the operating zone of the RFID tag 10 placed proximate to the object 20. The electronic reader 30 sends an electronic signal to activate the RFID tag 10. In step 203 of FIG. 2, the passive RFID tag 10 receives the electronic signal from the electronic reader 30 and gets activated. The activated RFID tag 10, in turn, transmits the encoded identification information about the object 20, to the electronic reader 30. In case of an active RFID tag 10, according to step 203*a* of FIG. 2, the RFID tag 10 is always active and emits electronic signals. The palm device equipped with the electronic reader enters the operating zone and receives the electronic signals from the active RFID tag 10, about object 20. In the following step 204 of FIG. 2, the electronic reader 30 receives the information about the object 20, decodes, verifies and validates the information and transmits the validated information to the data processing device 50 over the communication link 40. The data processing device 50 could be a computing device housing a database, such as a personal computer, a desk-top computer, a computer workstation, or similar devices. The communication link 40 could use wireless technology or wired technology. Example of a wireless technology may be Blue-tooth technology, 802.11 technology, 802.11a technology or 802.11b technology. In the following step 205, the data processing device 50 queries the database using the information from the electronic reader 30 and triggers a program for the object 20. In the current embodiment of the invention, the program could be an audio and video clip detailing the proper way of using the exercise machine. The program could be an audio or video or audio and video clip about the object 20. The final step in this process, step 206, is to present the program with audio and video clips to the user on an output device. The output device could be a computer monitor, video monitor, TV screen, video screens, touch screen or Liquid Crystal Display screen or any other audio and/or video device and may be located proximate to the electronic reader 30, proximate to the object 20, or proximate to the data processing device 50. The communication between the computing device and the output device may be wired or wireless.

Figure 3:
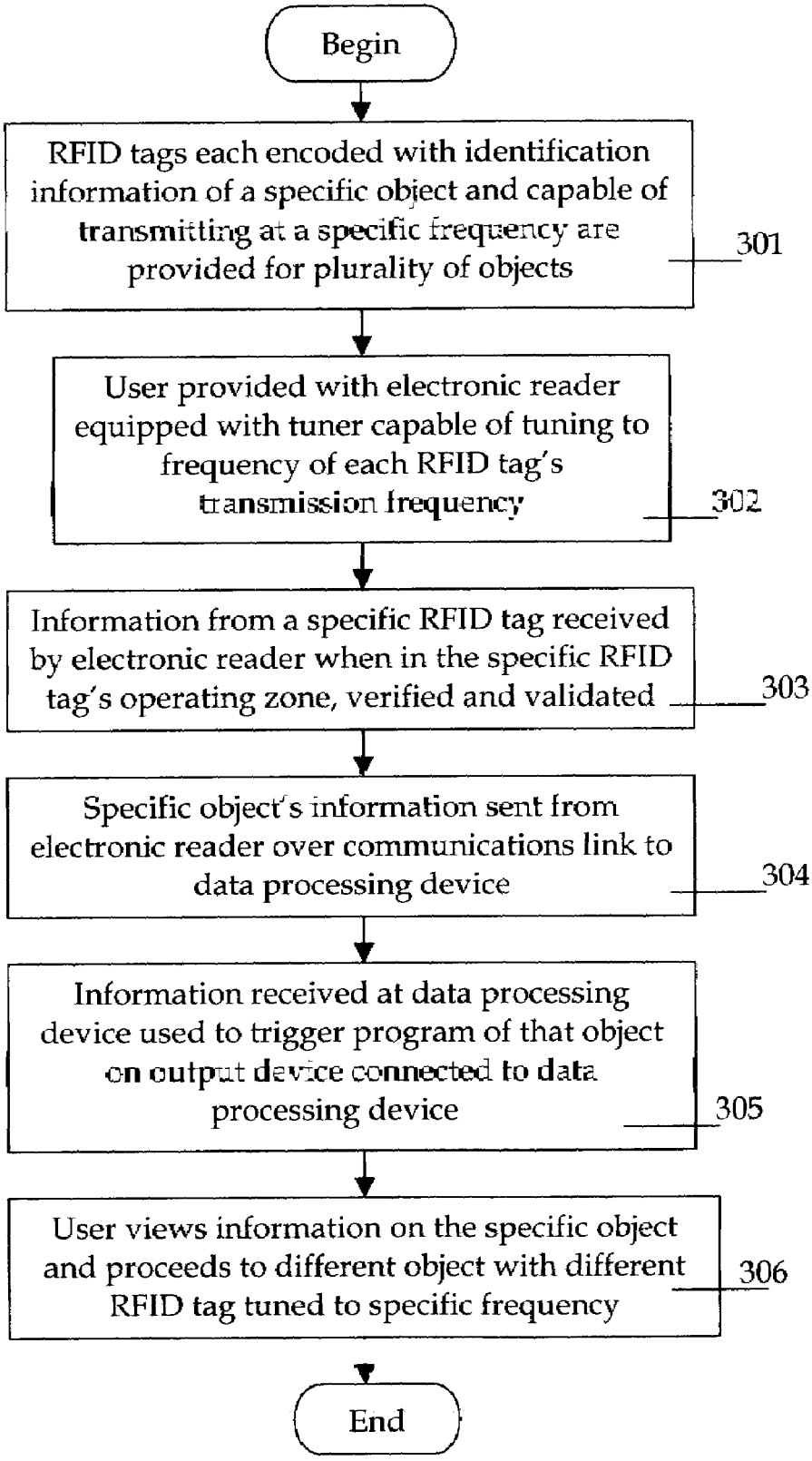
FIG. 3 is a flowchart of the process of reading an RFID tag from among a plurality of tags associated with plurality of exercise equipments (object) and triggering a program appropriate to the relevant tag's object on a data processing device.
Figure 4:
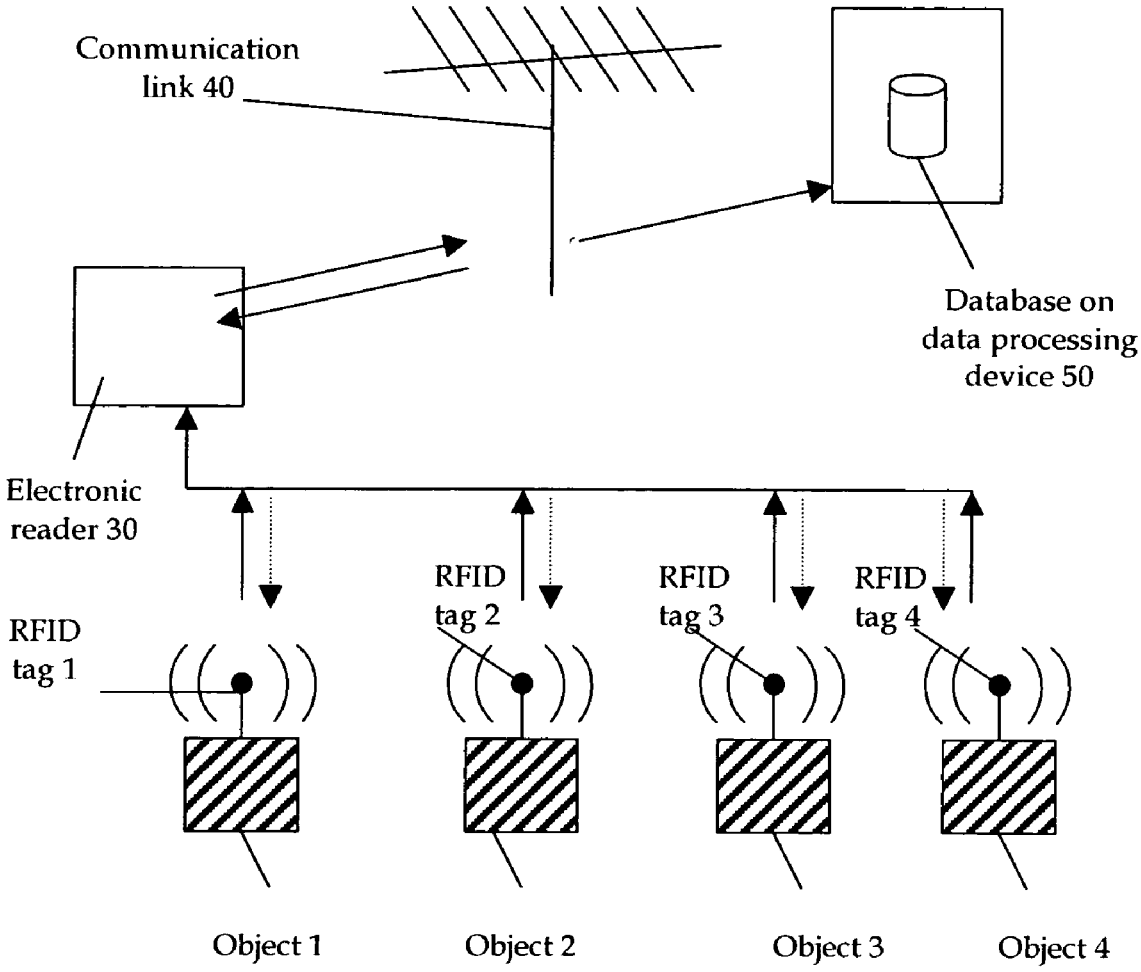
FIG. 4 is a schematic representation of an object information retrieval system using a plurality of RFID tags, each tag associated with different exercise equipments, using RFID communication devices for transmitting and receiving electronic signals.

In another embodiment of the invention, a plurality of objects each equipped with RFID tags of its own, are provided. FIG. 3 illustrates the flowchart of various steps involved and FIG. 4 illustrates the schematic representation of one such system. In this embodiment, for example, four objects each equipped with RFID tags of their own (For example: object 20-1 with RFID tag 1, object 20-2 with RFID tag 2, object 20-3 with RFID tag 3, object 20-4 with RFID tag 4 respectively) are provided. In step 301 of FIG. 3, each RFID tag (1–4) is encoded with identification information of the respective object (For example: RFID tag 1 with identification information of object 20-1, RFID tag 2 with identification information of object 20-2, RFID tag 3 with identification information of object 3 and RFID tag 4 with identification information of object 20-4) and placed proximate to the relevant object (20-1 through 20-4) so as to transmit electronic signals about that object without interruption. The electronic reader 30 is connected to a data processing device 50 using communication link 40. In FIG. 4, the RFID tags 1–4 are represented as passive tags. Active tags can be employed to serve the same purpose as the passive tags. In this embodiment, with the passive tag, when the electronic reader 30 enters the operating range of a particular RFID tag, RFID tag 1 for example, the electronic signals from the electronic reader 30 activates the passive RFID tag 1 which, in turn, transmits the identification information of object 20-1 to the electronic reader 30. One way the electronic reader can enter the operating zone of RFID tag 1, as indicated in step 302 for example, is by allowing the electronic reader 30 be embedded in a mobile hand-held device a user carries around and the user enters the operating zone of the RFID tag 1. The electronic reader 30 receives the identification information about object 20-1, decodes, verifies and validates the information, as indicated in step 303 of FIG. 3, and transmits the decoded information to the data processing device 50 through the communication link 40, as indicated in step 304 of FIG. 3. Upon receipt of this electronic signal from the electronic reader 30, the data processing device 50 queries a database for object 20-1 and activates a program associated with object 20-1 on the output device, as indicated in step 305 of FIG. 3. The electronic reader 30 can proceed to receive electronic signals from a different RFID tag (RFID tag 2, for example) and activate the program associated with object 20-2, for example, on the data processing device 50 after decoding, verifying and validating the information received from RFID tag 2, as indicated in step 306 of FIG. 3. The RFID tags on the objects could be positioned so as to not overlap the operating range of one another or the RFID tags could be programmed to emit varied intermittent electronic signals so as to not overlap or interrupt the signals coming from different RFID tags. The output device could be a computer monitor, video monitor, TV screen, video screens, touch screen, Liquid Crystal Display screen or any other audio and/or video device and may be located proximate to the electronic reader 30, proximate to the object 20, or proximate to the data processing device 50. The communication between the computing device and the output device may be wired or wireless.

The current invention could also be used in the maintenance and general repair of an exercise machine. The program associated with various parts of the exercise equipment (object) 20 could include details of the various parts of object 20, how to access various parts and do routine maintenance of the various parts of object 20, common problems that can be encountered, and detailed information on how to access various parts of object 20 and repair them. Accordingly, a plurality of RFID tags 10 are used, each RFID tag 10 encoded with information on different parts of object 20 and placed proximate to the appropriate parts within object 20. An electronic reader 30 is used to activate the appropriate parts' RFID tag 10, if the RFID tag 10 is passive, and receive identification information on the specific part of the object 20. The electronic reader 30 decodes and validates the information received and transmits this decoded information to a data processing device 50 using communication link 40. The data processing device 50 queries a database and activates the program associated with the specific part of object 20 on to the output device. The program includes detailed audio and/or video information on the specific part of object 20, common problems encountered, how to access the specific part of object 20 and instruction on how to perform repair on the specific part of object 20 to resolve the problem, in case of a problem, or in the case of a routine maintenance, how to perform the maintenance. The output device could be a computer monitor, video monitor, TV screen, video screens, touch screen, Liquid Crystal Display screen or any other audio and/or video device and may be located proximate to the electronic reader 30, proximate to the object 20, or proximate to the data processing device 50. The communication between the computing device and the output device may be wired or wireless.

The RFID tag 10 could be positioned in such a way so as to transmit uninterrupted electronic signals to the electronic reader 30, when activated. One way this could be done is by positioning each of the RFID tags 10 in such a way that the operating area of each of the RFID tags 10 is not overlapped by another RFID tag's operating area. Another way of doing it is to program the RFID tag to send variable intermittent electronic signals instead of contiguous electronic signals so that the signals could be read without interruption from other RFID tags.

The data processing device 50 could be a remote computing device or could be integrated with the electronic reader 30. In case of remote data processing device 50 a communication link 40 can establish the communication link between the device that houses the electronic reader 30 and the data processing device 50. The communication link 40 could use a) hard-wire technology such as network cables or the like, or b) could use the wireless technology such as blue-tooth technology or the like. The electronic reader 30 could be an independent unit by itself or could be embedded into another device. The frequency of the electronic signal used in the communication between the RFID tag 10 and the electronic reader 30 are pre-determined according to the communication protocol.

While the present invention was described with respect to particular embodiments, it will be apparent to those skilled in the art that various modifications and variations can be made in the method and system of the present invention. The specifications and examples should be considered exemplary only. It is intended that the present invention include variations and modifications that are within the scope of the appended claims.

What is claimed is:

1. A system to retrieve information related to an object comprising:

a RFID tag proximate to said object, said RFID tag storing data related to said object;

an electronic reader, said electronic reader configured to receive electronic signals from said RFID tag; and a data processing device operatively linked to said electronic reader, said electronic reader configured to send electronic signals to said data processing device, said data processing device configured to launch a program associated with operational information of said object on said data processing device upon receipt of electronic signals from said electronic reader;

wherein the operational information of the object includes information related to a plurality of parts of the object, wherein the operational information related to the plurality of parts include maintenance information on each of the plurality of parts of the object.

2. The system of claim 1, wherein said data processing device further comprising a database, said database storing said program of said object, said data processing device launching said program associated with operational information of said object from said database upon receipt of said electronic signals from said electronic reader.

3. The system of claim 1, wherein said electronic signal radiating from said RFID tag over a given area having a predetermined frequency, wherein said electronic reader is tuned to said predetermined frequency to receive said electronic signal from said RFID tag.

4. The system of claim 1, wherein said RFID tag is one of a passive tag or an active tag.

5. The system of claim 1, wherein said RFID tag is a read-only tag.

6. The system of claim 1, wherein said RFID tag further comprising:

a) an integrated circuit, said integrated circuit communicating with said reader;

b) a memory bank to store an identification information on said RFID tag;

c) an antenna attached to said integrated circuit to transmit and receive electronic signals to and from said electronic reader; and d) a tuning capacitor.

7. The system of claim 1, wherein said electronic reader further comprising:

a) an electronic circuit to send and receive data to and from said RFID tag;

b) a microprocessor to verify validity of said data, said microprocessor capable of checking and decoding data received from said RFID tag;

c) a memory module, said memory module capable of receiving and storing said data from said RFID tag; and d) an antenna for transmitting and receiving electronic signals from said RFID tag.

8. The system of claim 1, wherein said data processing device is linked to said object by use of wireless data transmission technology.

9. The system of claim 2, wherein said operational information of said object includes one of an audio component, a video component or an audio and video component.

10. The system of claim 8, wherein said launching of program associated with said object displayed on an output device, said output device connected to any one of said electronic reader or the data processing device.

11. The system of claim 1, wherein said object is an exercise machine.

12. A method to retrieve information related to an object comprising the steps of:

a) providing a RFID tag for an object, said RFID tag encoded with data related to said object, said RFID tag configured to transmit electronic signals at specific frequency;

b) receiving information from said RFID tag for said object on an electronic reader, said electronic reader configured to validate said information received from said RFID tag and transmit object related information using electronic signals; and c) providing a data processing device, said data processing device communicatively connected to said electronic reader, said data processing device configured to identify said object and launch a program associated with operational information of said object upon receipt of electronic signals from said electronic reader;

wherein the operational information of the object includes information related to a plurality of parts of the object, wherein the operational information related to the plurality of parts include maintenance information on each of the plurality of parts of the object.

13. The system of claim 1, wherein the data processing device is a computing system external to the electronic reader.

14. The method of claim 12, wherein said operational information includes one of an audio component, a video component or an audio and video component.

15. The method of claim 12, wherein launching the program further comprising:

accessing the appropriate program for the object based on the information received from the reader, the program related to the object housed within the data processing device or on an external system accessible by the data processing device; and executing the accessed program for the object on the data processing device.

16. The method of claim 15, wherein the execution of the program is on an output device attached to one of the data processing device or the reader.

17. The system of claim 1, further includes one or more additional RFID tags, the one or more additional RFID tags associated with one or more parts of the object, the additional RFID tags storing data corresponding to the one or more parts of the object and placed proximate to the corresponding parts so as to transmit stored data related to the parts of the object, the electronic reader configured to receive electronic signals from the additional RFID tags, the data processing device configured to launch a program associated with operational information of corresponding one or more parts of the object on said data processing device upon receipt of electronic signals from the electronic reader.

* * * * *